United States Patent [19]

Maeda et al.

[11] Patent Number: 4,935,787

[45] Date of Patent: Jun. 19, 1990

[54] COLOR COPIER OPERABLE BOTH IN MONOCHROMATIC AND FULL-COLOR COPYING MODES

[75] Inventors: Yasutaka Maeda, Nara; Hiromi Washio, Osaka; Tsuyoshi Miyamoto, Osaka; Yukihiko Ueno, Osaka, all of Japan

[73] Assignee: Sharp Kabushiki Kaisha, Osaka, Japan

[21] Appl. No.: 291,181

[22] Filed: Dec. 28, 1988

[30] Foreign Application Priority Data

Dec. 28, 1987 [JP] Japan ..... 62-333106

[51] Int. Cl.[5] ..... G03G 15/01

[52] U.S. Cl. ..... 355/326; 355/327

[58] Field of Search ..... 355/208, 214, 326, 327, 355/68, 69

[56] References Cited

U.S. PATENT DOCUMENTS

| | | | |
|---|---|---|---|
| 3,947,117 | 3/1976 | Basu et al. | 355/69 X |
| 4,236,809 | 12/1980 | Kermisch | 355/326 |
| 4,239,374 | 12/1980 | Tatsumi et al. | 355/214 |
| 4,653,904 | 3/1987 | Imamura | 355/214 X |
| 4,723,146 | 2/1988 | Kasahara | 355/326 |
| 4,791,452 | 12/1988 | Kasai et al. | 355/326 |
| 4,831,415 | 5/1989 | Kasuya | 355/208 |
| 4,841,335 | 6/1989 | Kohyama | 355/326 X |

*Primary Examiner*—Fred L. Braun

*Attorney, Agent, or Firm*—Flehr, Hohbach, Test, Albritton & Herbert

[57] ABSTRACT

A color copier operable both in monochromatic and full-color copying modes is controlled by a central processing unit programmed to exercise a real-time control of operation by detecting image characteristics of an original to be copied if a monochromatic copying mode is selected. If a full-color copying mode is selected, the image characteristics are preliminarily detected by scanning before a copying operation is started.

4 Claims, 5 Drawing Sheets

COLOR COPIER OPERABLE BOTH IN MONOCHROMATIC AND FULL-COLOR COPYING MODES

BACKGROUND OF THE INVENTION

This invention relates to a color copier operable both in monochromatic and full-color copying modes and, more particularly, to such a color copier which allows the quality of its copy image to be quickly and easily adjusted both in the monochromatic and full-color copying modes of operation.

With the recent progress in the technologies related to electrophotographic copiers, there are now being developed color copiers capable of forming full-color pictorial images. Such a color copier is provided, for example, with color filters for separating reflected light from an original document to be copied into light beams of three primary colors (blue, green and red) and three developing devices using toners of their complementary colors (yellow, magenta and cyanic) and forms a full-color image by repeating the process of forming a toner image three times. To explain this process more in detail, blue light is used to form a yellow toner image, green light is used to form a magenta toner image, red light is used to form a cyanic toner image, and these three toner images are superposingly transferred onto a single sheet of paper to form a full-color copy image.

Most full-color copiers of this type can be operated also in a monochromatic copying mode wherein a copy image is formed either in black or in one of the aforementioned three primary colors. When such a copier is operated in a monochromatic copying mode, the image quality is usually controlled on a real-time basis, as done by prior art black-and-white copiers, by detecting the condition of the original during the copying process and setting the conditions of copying such as exposure on the basis of the detected data. When this copier is operated in a full-color copying mode to superpose a plurality of toner images, however, adjustments of image quality are complicated, including color corrections according, for example, to the particular color characteristics of the original. In other words, image quality cannot be adjusted by a real-time control and exposure, photoreceptor surface voltage and bias voltage of the developing device are manually set. Typically, the operator conducts a series of tests by varying the photoreceptor surface voltage, etc. and manually sets the exposure, the photoreceptor surface voltage, etc. to appropriate values.

In summary, when a full-color copier is operated in a full-color copying mode, real-time control of the type used in the monochromatic copying mode of operation cannot adjust the image quality adequately. On the other hand, manual adjustments are time-consuming and economically disadvantageous because many copying operations must be repeated. Moreover, manual adjustments require a skilled operator and less experienced persons cannot be expected to perform them adequately. A full-color copier may be provided only with a means for automatically adjusting the image quality when it is operated in a full-color copying mode, such a copier is inefficient, requiring an unreasonably long time for the adjustment of image quality when operated in a monochromatic copying mode.

SUMMARY OF THE INVENTION

It is therefore an object of the present invention to provide a color copier which can be quickly and economically operated both in monochromatic and full-color copying modes.

A color copier embodying the present invention operable both in monochromatic and full-color copying modes, with which the above and other objects can be achieved, is characterized as comprising real-time control means for detecting image characteristics of an original document and thereby adjusting image quality during a copying process, preliminary scan control means for preliminarily detecting the image characteristics of the document and thereby adjusting its image quality prior to the copying process and selecting means for selecting the real-time control means if the copier is to be operated in a monochromatic copying mode and the preliminary scan control means if the copier is to be operated in a full-color copying mode. In other words, image quality is controlled by a color copier of the present invention by using its real-time control means or preliminary scan control means, depending upon whether the copier is in a monochromatic or full-color copying mode of operation, respectively. Thus, when the copier is operated, a selection is made on its control panel to determine whether it is going to be operated in a monochromatic copying mode or in a full-color copying mode. If a monochromatic copying mode is selected, the copier operates like conventional black-and-white copiers, performing a real-time control of the image quality by detecting during the copying process the image characteristics of the original being copied and calculating and setting exposure according to the detected information. If a full-color mode of operation is selected, on the other hand, an optical scanner is caused to perform a preliminary scan to detect the image characteristics of the original document to be copied and a copying process is started after the exposure, the surface voltage of the photoreceptor and/or the bias voltage for the developing device is set on the basis of the information thus detected to adjust the image quality.

As a result, time is not wasted with a copier of the present invention when operated in a monochromatic copying mode because the image quality can be adjusted as done by a conventional black-and-white copier. If a full-color copying mode is selected, it takes longer for the adjustment because of the preliminary scan by the optical scanner but copies with good image quality can be obtained from the beginning.

In short, a color copier according to the present invention is equally effective in adjustment of image quality both in its monochromatic and full-color copying modes. It is not necessary to make many test copies in the full-color mode of operation. Thus, it is economical and easy to operate even by less experienced persons.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DESCRIPTION OF PREFERRED EMBODIMENTS

Figure 1:
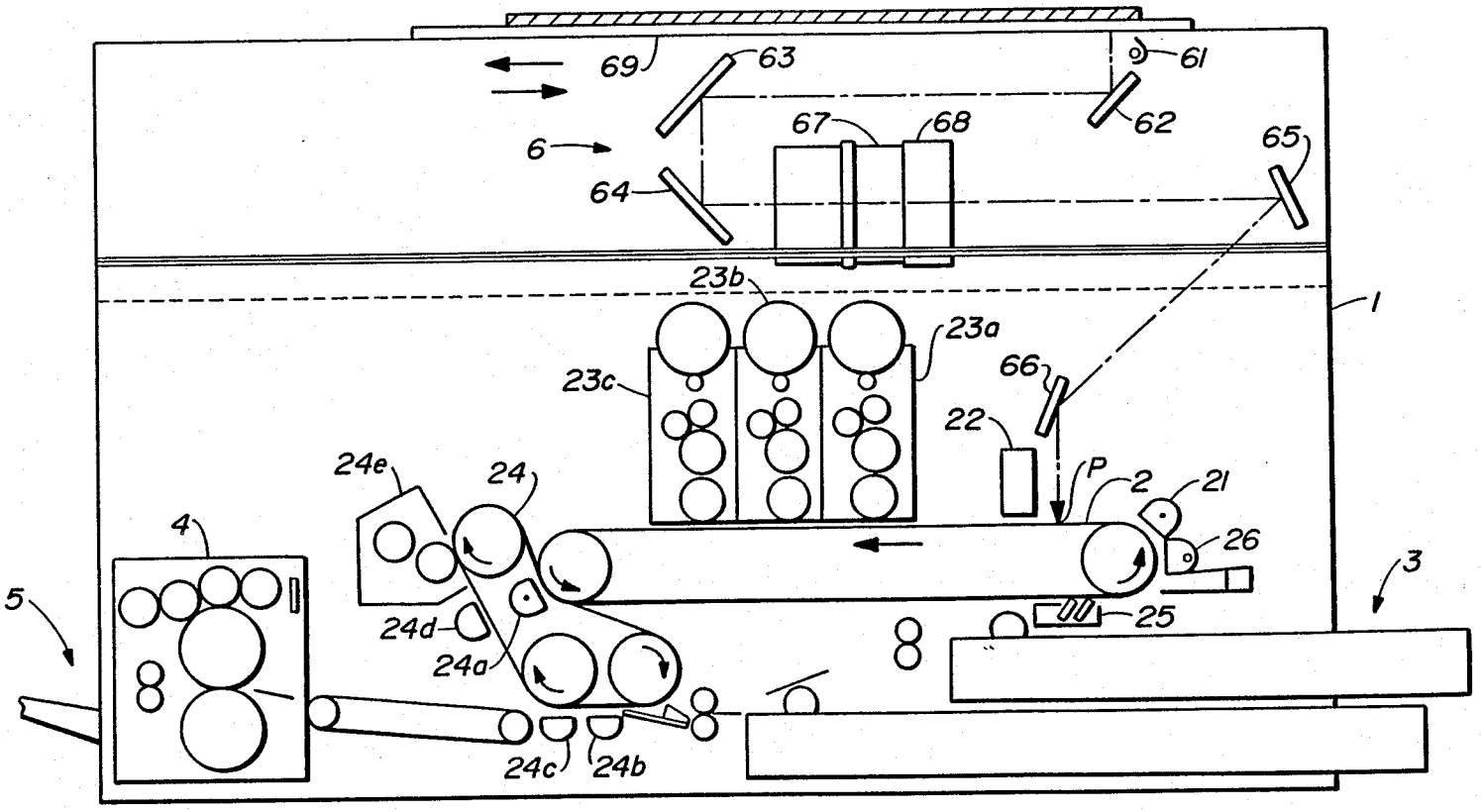
FIG. 1 is a schematic drawing of the structure of a color copier embodying the present invention.

As shown in FIG. 1, a color copier according to one embodiment of the present invention has a belt-like photosensitive body 2 horizontally disposed nearly at the center of its housing structure 1. This belt-like photosensitive body 2 is wrapped around a pair of pulleys and moves in the direction shown by arrows. Disposed near the photosensitive body 2 and thereabove in the direction of its motion from the pulley on the right-hand side (with reference to FIG. 1), there are a primary charger 21, a blanking lamp 22 and three developing devices 23*a*, 23*b* and 23*c*. Disposed near the other one of the pulleys is an image transfer medium 24. Disposed near the photosensitive body 2 and along the direction of its motion around the right-hand pulley are a cleaning device 25 and a charge removing lamp 26. The three developing devices 23*a*, 23*b* and 23*c* are filled with yellow, magenta and cyanic toners, respectively.

The image transfer medium 24 is shaped like a belt, is wrapped around a plurality of pulleys so as to be moved circulatingly thereby and therearound and is pressed against the photosensitive body 2 where the latter is wrapped around the left-hand pulley. Near the image transfer medium 24 is a first transfer charger 24*a* opposite to the position where the transfer medium 24 and the photosensitive body 2 are in contact with each other. A second transfer charger 24*b*, a separator charger 24*c*, a charge removing charger 24*d* and a cleaning device 24*e* are also disposed near the transfer medium 24 along its direction of motion indicated by arrows and sequentially downstream from the first transfer charger 24*a*.

A paper supplying section 3 is disposed on the right-hand side of the housing structure 1. On the opposite side of the housing structure 1 are a fixing device 4 and a paper discharge section 5. The upper part of the housing structure 1 is occupied by an optical system 6 including a lens 67, color filters 68, etc. and serving to expose and scan an original document to be copied which is placed on a document table 69 at the top surface of the housing structure 1. The optical system 6 further serves to lead the reflected light from the original to an exposure point P defined on the photosensitive body 2. The color filters 68 serve to selectably and selectively transmit only blue, green or red light.

Next, the full-color copying mode of operation of this copier is explained in detail. When the optical system 6 exposingly scans a color original, the color filters 68 initially so operate as to transmit therethrough only the blue part of the reflected light from the original and the transmitted blue light is directed to the exposure point P on the photosensitive body 2. As a result, a latent image corresponding to the blue image data of the original is formed on the photosensitive body 2 and yellow toner (of the color complementary to blue) is attached by the developing device 23*a* onto this latent image. The yellow toner image thus formed on the photosensitive body 2 is thereafter transferred onto the image transfer medium 24 by means of the first transfer charger 24*a*. Next, the optical system 6 scans the color original again but the color filters 68 operate this time so as to transmit therethrough only the green part of the reflected light from the original and the transmitted green light is similarly directed to the exposure point P on the photosensitive body 2 to form thereon another latent image, corresponding to the green image data of the original. Magenta toner is attached to this latent image to form a magenta toner image which is subsequently transferred onto the image transfer medium 24 matchingly at the position thereon where the yellow toner image was formed. Further thereafter, the optical system 6 scans the color original for the third time with the color filters 68 so operating this time as to transmit therethrough only the red part of the reflect light from the original and the transmitted red light is again directed to the exposure point P on the photosensitive body 2 to form thereon still another latent image, corresponding to the red image data of the original. Cyanic toner is attached to this latent image to form a cyanic toner image which, too, is subsequently transferred onto the image transfer medium 24 matchingly at the position thereon where the yellow and magenta toner images were formed. The toner image thus formed in three colors on the image transfer medium 24 is then transferred onto a transfer sheet of paper supplied from the paper supplying section 3 and after this transferred image is fixed by the image fixing device 4, the transfer sheet is discharged from the housing structure 1 through the discharge section 5. This is how a full-color image is formed.

Figure 2:
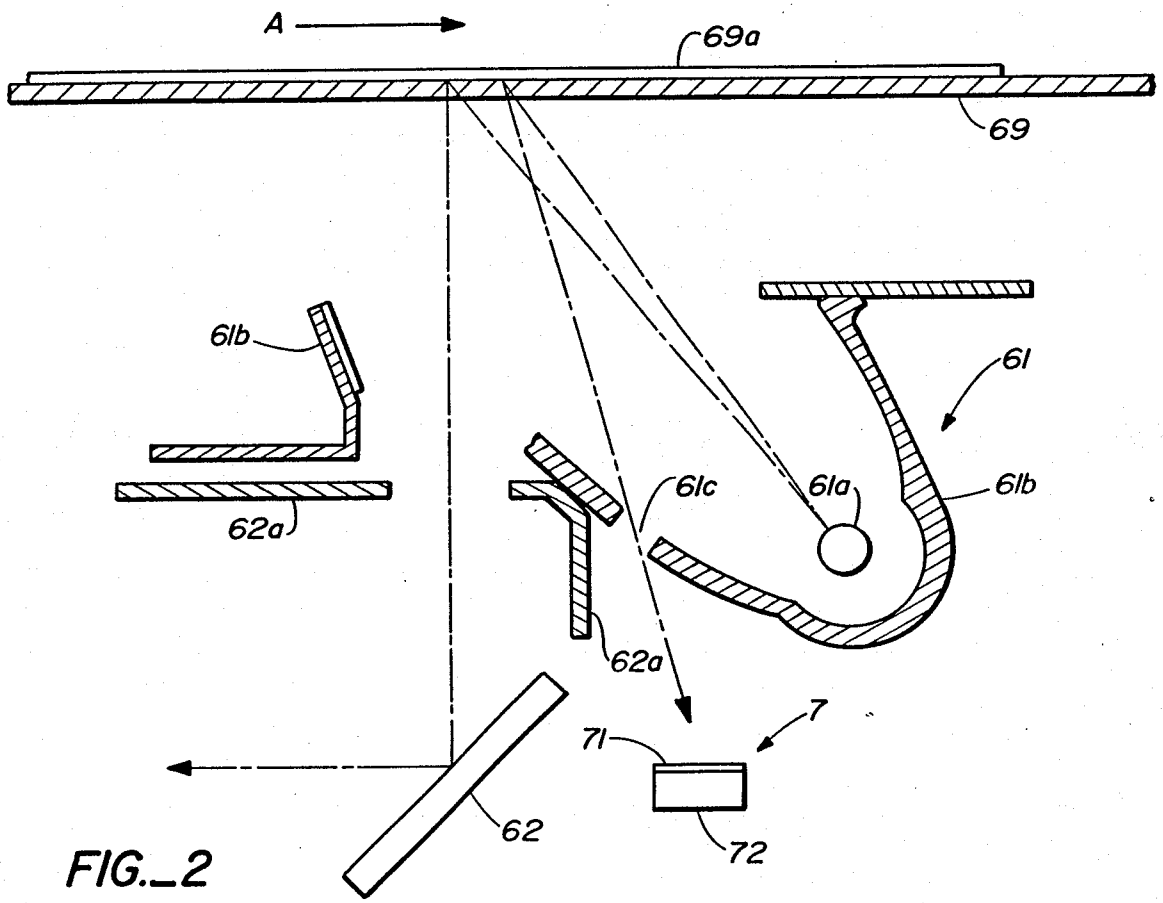
FIG. 2 is a drawing of the light source of the copier of FIG. 1 and components in its neighborhood.

As shown in FIG. 2 more in detail, the optical system 6 includes a light source 61 having an exposure lamp 61*a* surrounded by a reflector 61*b* so disposed that light from the exposure lamp 61*a* is projected to the document table 69 at the time of scanning in the direction indicated by arrow A. This reflector 61*b* serves not only to converge the light from the exposure lamp 61*a* but also to direct this converged light in a desired direction so as to prevent the generation of a stray beam. The beam of light from the exposure lamp 61*a* is reflected by an original document 69*a* placed on the document table 69 and is directed to a mirror 62 which is mostly covered by another reflector 62*a*. The reflector 62*a* is provided with a slit and the reflected light from the original document 69*a* is made incident onto the mirror 62 through this slit formed in the reflector 62*a* which also serves to prevent stray light from reaching the mirror 62. A photosensor 7 having a filter 71 and a photometer 72 is disposed below the light source 61 such that a portion of light reflected from the original document 69*a* on the document table 69 is passed through a slit in the reflector 61*b* to be received by this photosensor 7. The light source 61, the mirror 62 and the photosensor 7 are unistructurally formed and move as a unit when the original document 69*a* on the document table 69 is scanned.

Figure 3:
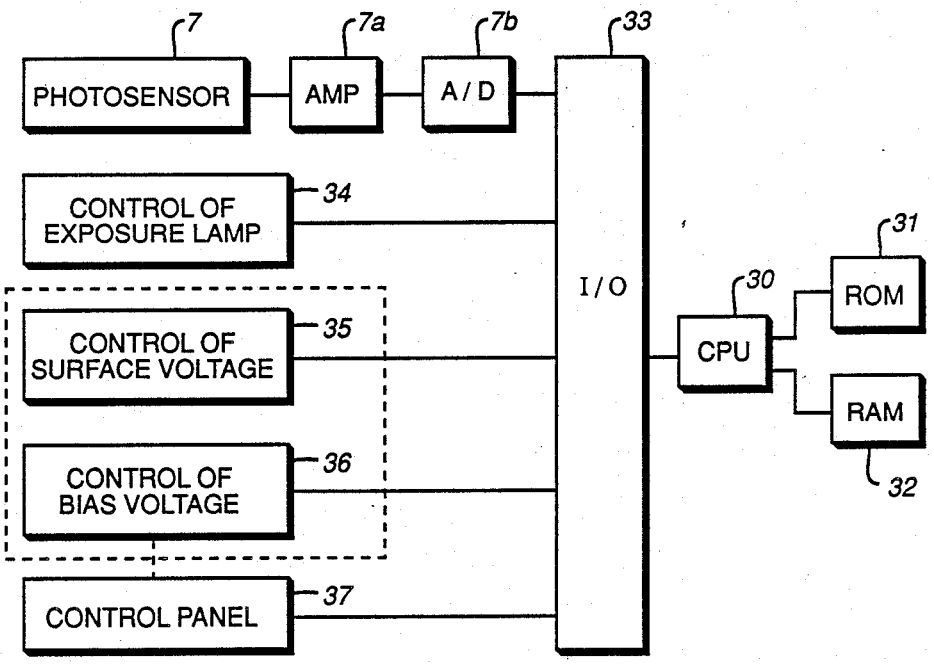
FIG. 3 is a block diagram of a part of the control system of the copier of FIG. 1.

As shown in FIG. 3, the control system of the copier includes a central processing unit (CPU) 30 connected to a read-only memory (ROM) 31, a random-access memory (RAM) 32 and an input/output interface circuit (I/O) 33. Control units 34, 35 and 36 respectively for the exposure lamp 61*a*, the surface voltage of the photosensitive body 2 and the bias voltage for the developing and a control panel 37 are also connected to the CPU 30 through the I/O interface 33.

The CPU 30 serves to control the overall operation of the copier according to a program preliminarily stored in the ROM 31. The RAM 32 is used as working areas when this program is executed. Selection of a copying mode is inputted through the control panel 37 and transmitted to the CPU 30 through the I/O interface 33. In order to adjust the image quality according to the selected copying mode, the CPU 30 operates to retrieve data from the ROM 31 and the RAM 32. In the case of a monochromatic copying mode, for example, the optical system 6 and the photosensitive body 2 are activated to start a copying process. The reflected light from the original document is thereupon received by the photosensor 7 and the output therefrom is amplified by an amplifier (AMP) 7*a*, converted into a binary signal by an analog-to-digital converter (A/D) and then inputted to the CPU 30 through the I/O interface 33. The CPU 30 instantly calculates an optimum exposure on the basis of this input signal and causes the control unit 34 to control the exposure lamp 61*a* accordingly. This real-time adjustment of image quality is continuously repeated.

In the case of a full-color copying mode, the CPU 30 does not start a copying process immediately. Instead, only the optical system 6 is activated to preliminarily scan the document to be copied. In this situation, the data from the photosensor 7 amplified by the amplifier 7*a*, converted into a binary signal by the A/D converter 7*b* and inputted to the CPU 30 through the I/O interface 33 are caused by the CPU 30 to be sequentially stored in the RAM 32. After the preliminary scanning is completed, the CPU 30 calculates the optimum values of exposure, the surface voltage of the photosensitive body 2 and the bias voltage for the development on the basis of the all data thus stored and controls the control units 34, 35 and 36 according to the calculated optimum values. After these control units 34, 35 and 36 are thus controlled, the optical system 6 and the photosensitive body 2 are activated to start a copying process.

Figure 4:
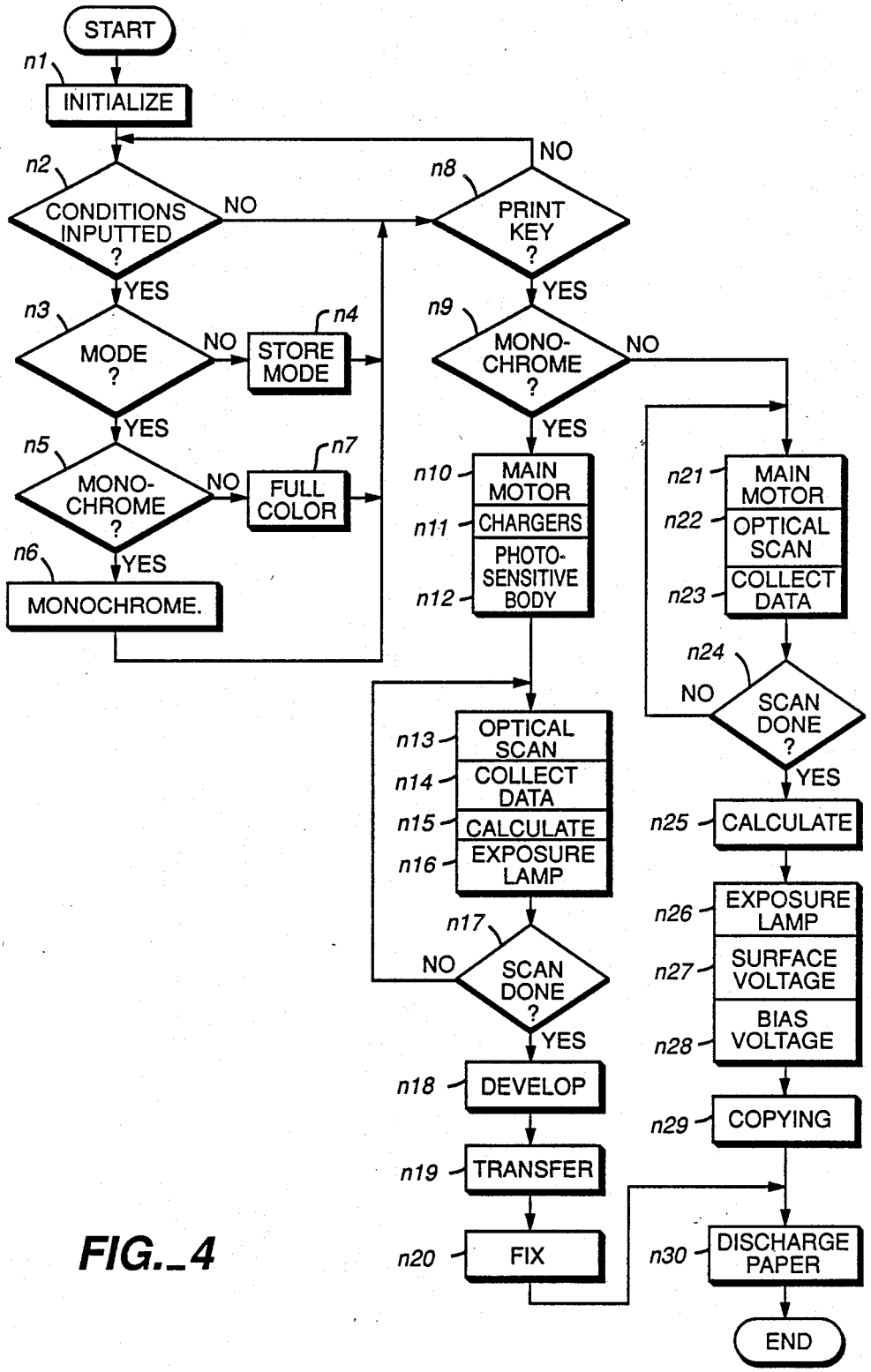
FIG. 4 is a flow chart of the adjustment of image quality by the copier of FIG. 1, and FIGS. 5A and 5B are respectively a time chart of components of the copier of FIG. 1 for adjustment of image quality by real-time control during its operation in a monochromatic copying mode and by preliminary scan control during its operation in a full-color copying mode.

With reference next to the flow chart of FIG. 4 which shows the process for adjusting image quality by a copier embodying the present invention, initialization takes place (n1) as soon as power is switched on, a monochromatic copying mode being automatically selected. When conditions of copying operation are inputted (n2), including the copying mode and the desired number of copies, it is determined whether a copying mode is included in the inputted data (n3) and conditions other than the copying mode are stored in the RAM (n4). If it is determined that a copying mode has been inputted, it is examined next whether the selected mode is a monochromatic copying mode (n5). If a monochromatic mode has been selected, this is recorded in the RAM (n6). If a full-color copying mode has been selected (NO in n5), this is also recorded in the RAM (n7). The system then waits until a print key (not shown) is operated (n8). In other words, if no copying mode is selected in Step n2, a monochromatic copying mode is assumed to have been selected.

When the print key is operated (n8) with a monochromatic copying mode selected (YES in n9), a main motor (not shown), the chargers and the photosensitive body 2 are activated (n10, n11 and n12) for starting a copying operation and the optical system 6 begins to scan the original document nearly simultaneously therewith (n13). The optical system 6 directs the reflected light from the document to the exposure point P on the photosensitive body 2 and the output from the photosensor 7 is sequentially received by the CPU 30 which, upon receiving these data (n14), immediately calculates the optimum exposure (n15) and controls the exposure lamp 61*a* accordingly (n16). This process is repeated until the copying operation is completed (YES in n17). After the image on the original document is exposed on the photosensitive body, the copier executes developing, transferring and fixing processes (n18, n19 and n20) sequentially in well-known manners and the transfer sheet with a toner image transferred thereonto is discharged from the housing structure 1 (n30).

If it is determined that a full-color copying mode has been selected (NO in n9), on the other hand, the copier does not start a copying process immediately but operates a main motor (not shown) (n21) for a preliminary scan of the original document to be copied (n22) and reads the data outputted from the photosensor 7 (n23). When this preliminary scan is completed (YES in n24), optimum conditions for the copying operation are calculated on the basis of these data (n25) and the control units 34, 35 and 36 are controlled accordingly (n26, n27 and n28) before the copying is started (n29). At the end of the copying, the transfer sheet thus produced is similarly discharged out of the housing structure 1 (n30).

Figure 5A:
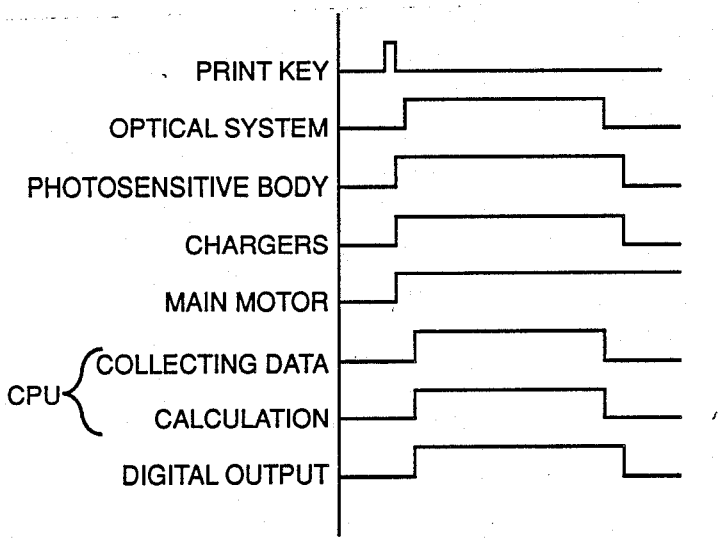
Figure 5B:
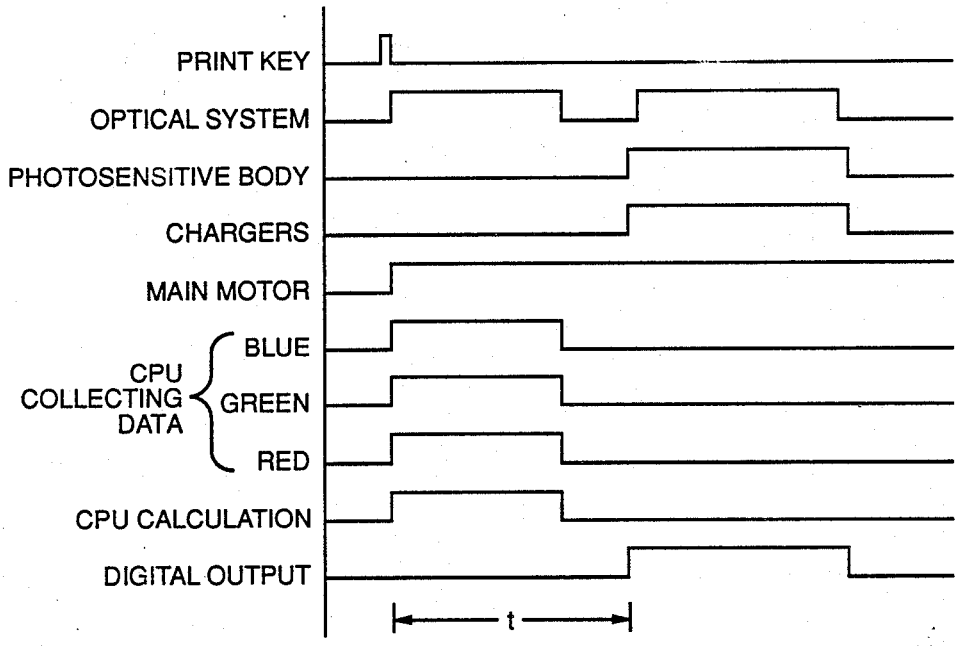

The timing schedules of various components of the copier are shown in FIGS. 5A and 5B respectively for the case of monochromatic and full-color copying mode of operation. In the case of a monochromatic copying mode of operation, all components of the copier start nearly simultaneously for a copying process as soon as the print key is operated and the CPU continuously calculates optimum copying conditions on the basis of output signals from the photosensor throughout this copying process. In other words, the CPU feeds back the data from the photosensor for a real-time control of the exposure lamp and hence of the image quality. In the case of a full-color copying mode of operation, the main motor is activated as shown in FIG. 5B when the print key is operated and this causes the optical system to start a preliminary scan. In the meantime, the photosensitive body and the chargers are not activated yet but wait until the preliminary scan of the original document to be copied is completed and data are gathered. When the data are gathered and the CPU calculates optimum copying conditions, the control units exercise their controls accordingly to adjust the image quality. Subsequently, the photosensitive body and the chargers are activated to start a copying process. In other words, there is a delay (represented by the length of time t required for the preliminary scan) in the full-color copying mode of operation as compared to the monochromatic copying mode of operation.

The foregoing description of a preferred embodiment of the invention has been presented for purposes of illustration and description. It is not intended to be exhaustive or to limit the invention to the precise form disclosed, and many modifications and variations are possible in light of the above teaching. Any such modifications and variations that may be apparent to a person skilled in the art are intended to be included within the scope of this invention.

What is claimed is:

1. A color copier operable both in monochromatic and full-color copying modes, said copier comprising real-time control means for detecting image characteristics of an original document and adjusting image quality during a copying process according to said detected image characteristics, preliminary scan control means for preliminarily detecting image characteristics of said original document and adjusting image quality prior to a copying process according to said preliminarily detected image characteristics, and selecting means for selecting said real-time control means if said copier is to be operated in a monochromatic copying mode and said preliminary scan control means if said copier is to be operated in a full-color copying mode.

2. The copier of claim 1 wherein said selecting means include a control panel.

3. The copier of claim 1 further comprising color filters for selectively transmitting light of specified colors sequentially.

4. The copier of claim 1 wherein said real-time control means and said preliminary scan control means are embodied in a single central processing unit.

* * * * *